United States Patent [19]

Balz

[11] 4,363,194

[45] Dec. 14, 1982

[54] VERTICAL SELF-SEPARATING CENTRIFUGAL FINISHING APPARATUS WITH AUTOMATIC MEDIA RETURN

[75] Inventor: Gunther W. Balz, Kalamazoo, Mich.

[73] Assignee: Roto-Finish Company, Inc., Kalamazoo, Mich.

[21] Appl. No.: 238,443

[22] Filed: Feb. 26, 1981

[51] Int. Cl.[3] ..... B24B 19/00

[52] U.S. Cl. ..... 51/163.1

[58] Field of Search ..... 51/163.1, 163.2, 164 R, 51/313

[56] References Cited

U.S. PATENT DOCUMENTS

| | | | |
|---|---|---|---|
| 1,460,731 | 7/1923 | Pickop | 51/164.1 |
| 2,290,036 | 7/1942 | Davis | 51/164.1 |
| 3,073,080 | 1/1963 | Balz | 51/163.2 |
| 3,073,082 | 1/1963 | Balz | 51/163.1 |
| 4,026,075 | 5/1977 | Balz | 51/313 |
| 4,177,608 | 12/1979 | Balz | 51/163.1 |

*Primary Examiner*—Harold D. Whitehead
*Attorney, Agent, or Firm*—Gordon W. Hueschen

[57] ABSTRACT

A finishing machine comprising a rotatable housing, which is preferably but not necessarily resiliently mounted, comprising: a finishing chamber for receiving and finishing parts with finishing media when the housing is in finishing position, a storage chamber adapted to receive media from the finishing chamber when the housing is rotated to a parts-separation position, a foraminous member for separating media from parts, apparatus for rotating the housing about a substantially horizontal axis from a finishing position to a parts-separation position and return, and apparatus for transfer of media from the storage chamber to the finishing chamber upon return of the housing from parts-separation position to finishing position, wherein the finishing chamber comprises an annular spinner member and complementary tub member, the spinner member being adapted to rotate about a generally vertical axis when the housing is in finishing position, and a rotational motion-producing assembly and associated drive operatively associated with the spinner member for rotation thereof, whereby the spinner member may be rotated with respect to the tub member for carrying out a finishing operation; a vibratory device for vibration of the foraminous member when the housing is in parts-separation position for separation of media from parts; and a parts exit associated with the foraminous member for exit of finished parts when the housing is in parts-separation position and under the influence of the vibratory means, is provided.

20 Claims, 5 Drawing Figures

VERTICAL SELF-SEPARATING CENTRIFUGAL FINISHING APPARATUS WITH AUTOMATIC MEDIA RETURN

BACKGROUND OF THE INVENTION

1. Field of the Invention

Finishing machines or apparatus, semiautomatic or batch-type, centrifugal finishing apparatus which is self-separating and which embodies an automatic media return.

2. Prior Art

Numerous self-separating finishing devices of the automatic, semiautomatic, and batch-type have previously been proposed. These have mainly been of the vibratory type, and have been satisfactory to the extent permitted by the permissible magnitude of the vibratory action which can be applied without damage to parts or workpieces being finished. Since vibratory apparatus of this type which has been previously available has not been able to produce high amplitudes of vibration, and especially since such high amplitudes of vibration are detrimental to finished parts during the process of separation from finishing media employed in the finishing process, serious restrictions upon the employment of such devices have been encountered. This has led to the necessity of lengthy period of vibration or gyration to complete the finishing process, with concurrent lack of economy. For such type of apparatus which was rotatable about an axis for separation employing a foraminous member or the like, the vibratory motor employed for the finishing was primarily located for effecting the finishing process and not for the separation step, so that the separation was grossly inefficient even when the vibratory means was actuated or continued in operation during the separation step. On the other hand, vertical centrifugal finishing devices have become increasingly popular during recent years because of their rapid finishing action, but efficient separation means or procedure has not previously been available for employment in or together with such centrifugal finishing devices. Accordingly, although finishing with such centrifugal finishing apparatus has to date been rapid, efficient, and economical, such advantages have been lost due to the inability to provide or even conceive a suitable and satisfactorily economical separation procedure and apparatus therefor, especially one which does not involve manual labor. Thus, at the present time the production of rotatable, vibratory finishing apparatus has essentially come to a standstill, whereas centrifugal finishing apparatus has not reached its full potential due to shortcomings in separation procedure and apparatus for use in combination therewith. Although these aforesaid concepts of rotatable vibratory finishing machines and of centrifugal finishing apparatus have both been available in the art for some time, since the middle 1960's or earlier, no satisfactory solution to the aforementioned shortcomings of each has been forthcoming. It is apparent that an improved finishing apparatus and procedure, which is not characterized by the inherent shortcomings, deficiencies, and inabilities of these two separate available prior art systems, would be highly desirable and would fulfill a long-felt need in the art. Such apparatus is provided by the present invention, which eliminates the inherent shortcomings and deficiencies of both of these prior art systems while retaining the most desirable characteristics and the advantages of both.

As representative of the prior art in these separate areas of the surface finishing field may be mentioned U.S. Pat. Nos. 3,073,078, 3,073,079, 3,073,080, 3,073,081, 3,073,082, 3,073,069, 3,435,567, 3,990,188, 4,026,075, 4,177,608, and U.S. Pat. No. RE 29,964.

OBJECTS OF THE INVENTION

The present invention has the following objects, inter alia: To provide a novel finishing machine or apparatus of the semiautomatic or batch type which combines the best features of the vertical centrifugal finishing apparatus and rotatable self-separating finishing machines which embody the feature of automatic media return, while at the same time eliminating the shortcomings of both. To provide a novel vertical centrifugal finishing apparatus which is self-separating. To provide a rotatable finishing apparatus with automatic media return which is truly self-separating. To provide a finishing machine in which the maximum potential of centrifugal finishing apparatus is exploited fully, but which still permits the rapid and efficient separation of finished parts or workpieces from the machine without the intervention of human labor. To provide a rapid and efficient and economical vertical centrifugal finishing machine from which finished parts may be rapidly and efficiently separated on an automatic, semiautomatic, or batchwise basis. To provide a rapid and efficient finishing machine from which finished parts or work pieces can be rapidly and efficiently separated. To provide an improved automatic, semiautomatic, or batchwise centrifugal finishing machine with automatic separation of finished parts, a combination which has not heretofore been available. Additional objects will be apparent to one skilled in the art, and still other objects will become apparent hereinafter.

The foregoing and additional objects are achieved by provision of the novel finishing apparatus according to the present invention.

SUMMARY OF THE INVENTION

The invention, in summary, includes the following:

A finishing machine for finishing the surface of unfinished parts with finishing media comprising a housing which is rotatable about a substantially horizontal axis and preferably but not necessarily resiliently mounted, a finishing chamber in said housing for receiving unfinished parts and finishing media and for finishing of parts when said housing is in finishing position, a storage chamber in said housing adapted to receive finishing media from said finishing chamber when said housing is rotated to a parts-separation or ejection position, a foraminous member disposed in said housing for separating finishing media from parts, means for rotating said housing about a substantially horizontal axis from a finishing position to a parts-separation position and return, and means for transfer of finishing media from said storage chamber to said finishing chamber upon return of said housing from said parts-separation position to said finishing position, characterized in that said finishing chamber comprises an annular spinner member constituting a lower portion of said finishing chamber and a preferably but not necessarily annular tub member upwardly, and preferably but not necessarily coaxially or concentrically, arranged with respect to said spinner member and constituting an upper portion of said finishing chamber, said spinner member being adapted to rotate about a generally vertical axis when said housing is in finishing position, a rotational motion-producing assembly operatively associated with said finishing chamber and comprising rotatable support means for said spinner member adapted to rotate about an axis which is substantially the same as the axis of its complementary spinner member when said housing is in finishing position and associated drive means for rotation of said rotatable support means, whereby said spinner member may be rotated with respect to said tub member for carrying out a finishing operation in said finishing chamber, and vibratory means operatively associated with said foraminous member for vibration of said foraminous member when said housing is in parts-separation position for separation of finishing media from parts, and a parts exit associated with said foraminous member for exit of finished parts from said machine when said housing is in parts-separation or ejection position and under the influence of said vibratory means; wherein said vibratory means comprise a vibratory motor adjacent said foraminous member; wherein said vibratory motor is affixed to said housing adjacent said foraminous member; wherein said vibratory motor is so located that its axis of rotation is transverse to the path of travel of said parts as they travel along said foraminous member and out said parts exit; wherein said parts exit comprises a chute located adjacent said foraminous member; wherein said foraminous member is located in said housing between said finishing chamber and said storage chamber; wherein said foraminous member comprises a screen or grate; wherein said transfer means is operative to transfer finishing media from said storage chamber to said finishing chamber, or alternatively out of said machine, upon return of said housing from parts-separation position to finishing position; wherein said transfer means comprises duct means including associated internal and external openings and door or damper means for alternatively directing said finishing media either to said finishing chamber or out of said machine; wherein said transfer means comprises duct means for directing said finishing media to said finishing chamber or out of said machine and wherein said vibratory means is also operatively associated with said duct means for assisting with travel of said finishing media along said duct means; wherein said housing constitutes a single-stage finishing unit; wherein said housing is divided into more than one compartment and wherein said machine constitutes a multi-stage finishing machine; wherein each compartment of said housing contains a separate foraminous member and wherein said foraminous member are so arranged for transfer of parts from one compartment to a next succeeding compartment upon rotation of said housing from parts-separating position to finishing position and finally to a parts exit for exit of finished parts from said machine; wherein each compartment is fitted with a suitable baffle for return of the finishing media in that compartment back to the finishing chamber of that compartment upon rotation of said housing from parts-separating position to finishing position; wherein said finishing chamber comprises an annular sealing member for sealing but rotatable engagement of said spinner member with said tub member; and wherein said rotatable support means for said spinner member comprise a vertical shaft journaled in bearings mounted adjacent said spinner member and below said spinner member when said housing is in finishing position and wherein said drive means comprises a motor, e.g., an electric or hydraulic motor, for driving said shaft.

DESCRIPTION OF PREFERRED EMBODIMENTS OF THE INVENTION

The invention, in several preferred embodiments, is illustrated by the accompanying drawings, in which:

FIG. 3 depicts a side view, partly in section, of a two-stage unit according to FIG. 4, illustrating how parts or work pieces move sideways from one stage to another while finishing media remains in the same stage.

SPECIFIC REFERENCE TO THE DRAWINGS

Reference is now made to the accompanying drawings for a better understanding of the invention, wherein all the essential parts are numbered and wherein the same numbers are used to refer to corresponding parts in all of the drawings.

Figures 1, 2, 5:
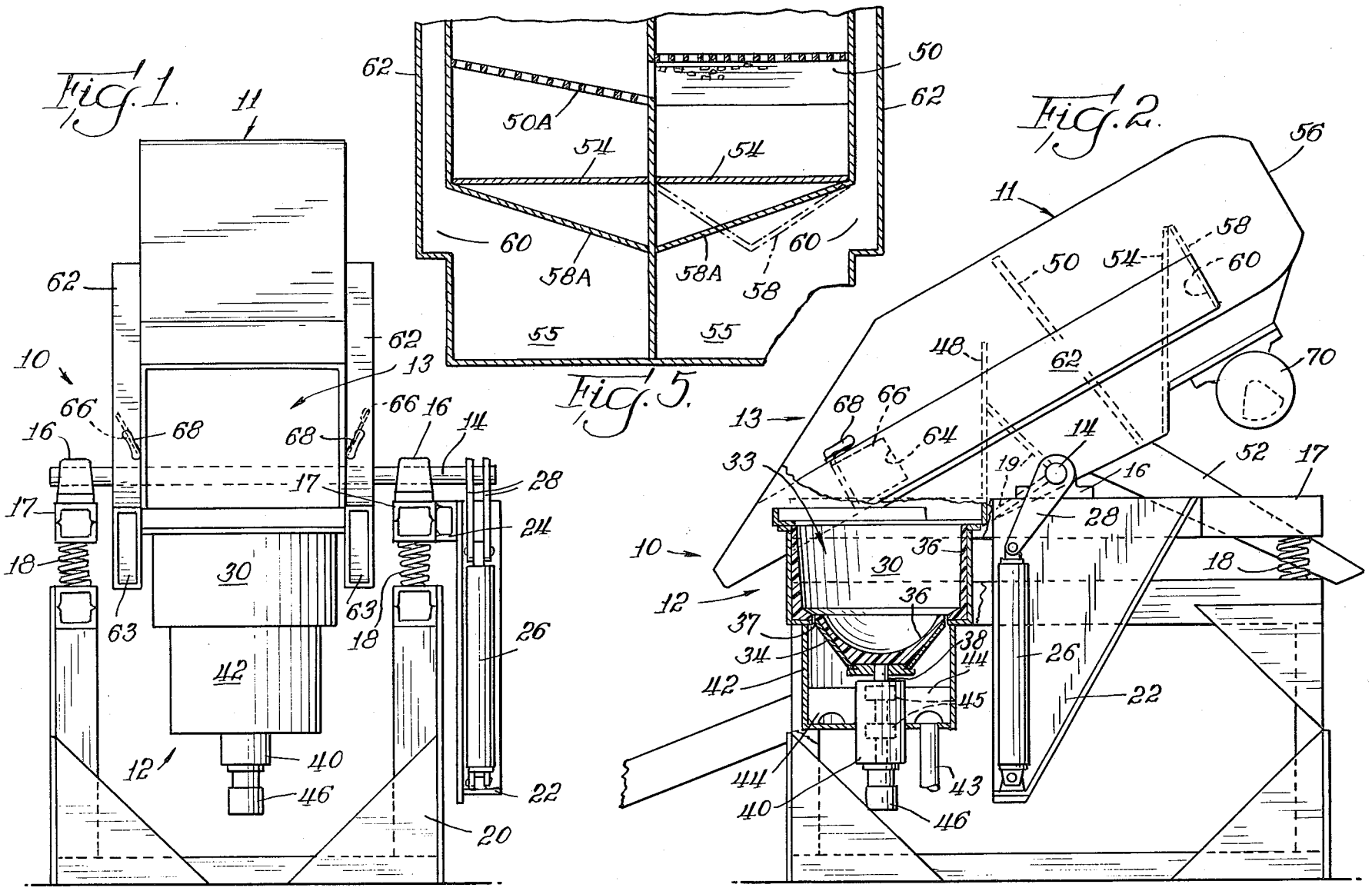
FIG. 1 is a front elevation of apparatus according to the present invention.
FIG. 2 is a side view of finishing apparatus of FIG. 1 according to the invention, partially in section.
FIG. 5 is a section view taken along line 5—5 of FIG. 3 when
Figure 4:
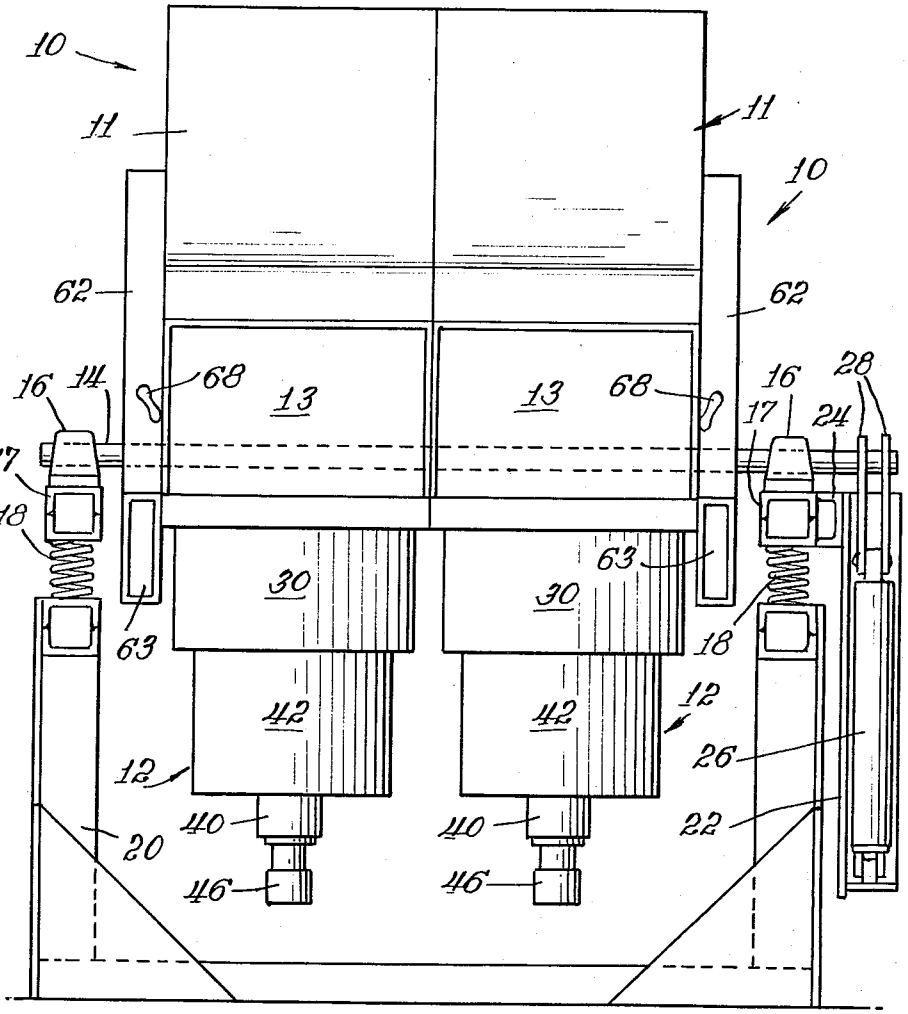
FIG. 4 is a front elevation of a multi-stage finishing device according to the invention.
Figure 3:
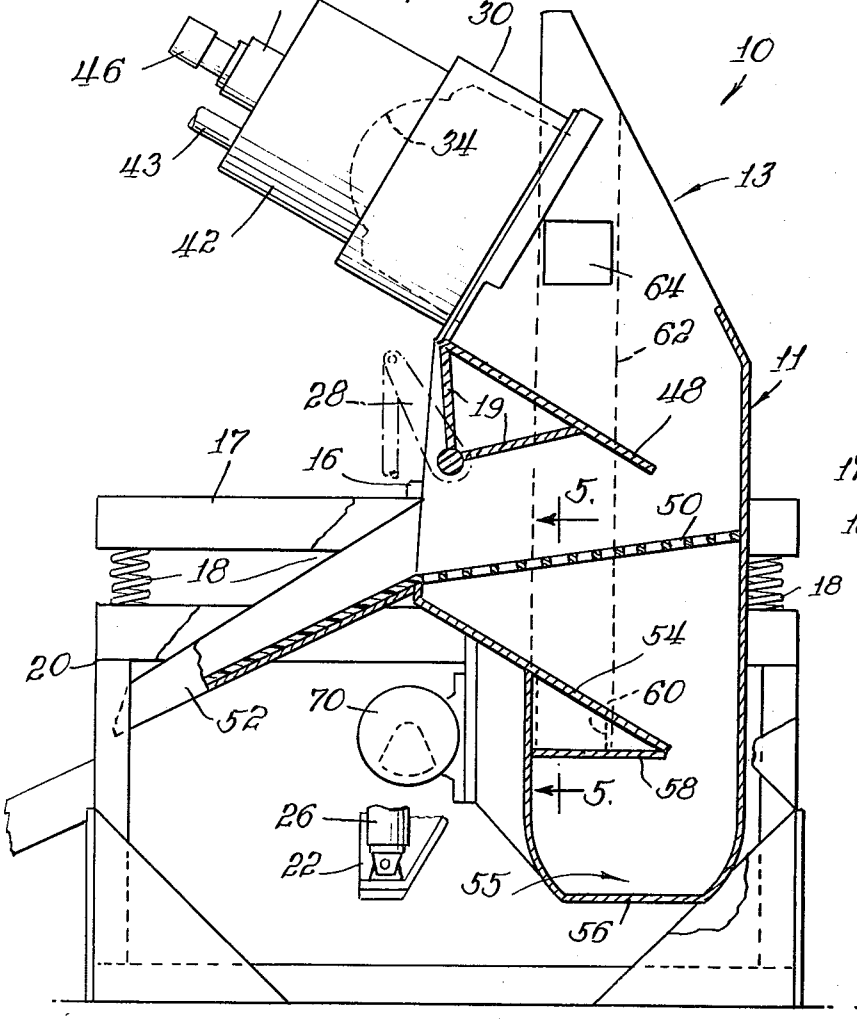
FIG. 3 is another side view, partly in section, but with the finishing device of the invention in parts-separation or ejection position (this view being the same whether the device in question is a single-stage unit of FIGS. 1 and 2 or a multi-stage unit of FIG. 4).

In a preferred single-stage form, the finishing apparatus of the invention is shown in FIG. 1. A multi-stage version, that is, a two-stage version, is depicted in FIG. 4. The view of FIG. 3 is equally applicable to a single-stage or a multi-stage unit such as depicted in FIG. 4. When FIG. 3 is a view of the two-stage unit of FIG. 4, FIG. 5 depicts a section taken along line 5—5 of FIG. 3 for purposes of showing how parts or workpieces are transferred from stage 1 to stage 2 and then out of the machine, while the finishing media for each stage remains in that stage, as will be further explained hereinafter.

The finishing apparatus of the present invention is shown generally at 10, being a vertical self-separating centrifugal finishing apparatus with automatic media return. The centrifugal finishing segment of the apparatus is shown generally at 12. The major portion of the apparatus comprises housing 11, which is rigidly affixed, by weldments assisted by reinforcing plates 19, to horizontal shaft 14, rotatably mounted in bearing blocks 16 and resiliently mounted on springs 18 between upper frame portion 17 and lower base member 20. Attached to upper frame portion 17 is channel piece 24, which spaces cylinder mounting bracket 22 outwardly at one side of the base 20. Rigidly mounted on said bracket 22 is cylinder 26 and associated arm 28 ridigly secured to shaft 14 for rotating the housing 11 and its components about a substiantially horizontal axis from finishing position to parts-separation or ejection position (which may also sometimes hereinafter be referred to as "media transfer position"), and vice versa. As shown in FIG. 1, a forward opening 13 in housing 11 permits introduction of parts to be finished and ducts 62 are located at both sides of the housing, having duct exterior opening 63 for exit of finishing media from the unit when desired. In the interior of duct 62, as shown in shadow lines, is damper 66 controlled by handle 68 for optional return of finishing media along ducts 62 either into tub portion 30 of centrifugal finishing segment 12 or for exit from the device through duct exterior opening 63, as desired. Centrifugal finishing segment 12 comprises tub portion 30, cylindrical housing 42 and plates 44 for support of bearing housing 40 and bearings 45 therewithin, with spinner bowl 34 being mounted on shaft 38, journaled in bearings 45, and centrifugal electric motor 46 for rotation of shaft 38 and powered from a source not shown.

As shown in FIG. 2 in finishing position with finishing segment vertically situated for a finishing operation, finishing chamber 33 comprises annular tub portion 30 and annular spinner bowl 34, both lined as usual with polyurethane or other elastomer 36, and having a suitable seal 37 at their juncture. An especially suitable type of seal is disclosed in U.S. Pat. No. 4,177,608, issued Dec. 11, 1979. Fluid passing said seal 37 during the finishing operation collects in the bottom of cylindrical housing 42 and is discharged from the machine through drain 43.

All of the other previously-identified elements are also apparent and, in addition, bottom 56 of separation segment, which defines the bottom of storage compartment 55 therein, crown- or V-shaped baffle 58 with associated plate 54 for directing finishing material from storage chamber or compartment 55 into duct opening 60, duct 62, foraminous member, i.e., screen or grate 50, and directional plate 48 for directing parts and media, on rotation of the device, from the finishing chamber onto foraminous member 50. Also shown is duct internal opening 64 associated with damper 66 and external handle 68 for directing finishing media from storage chamber or compartment 55 back into finishing chamber 33 via duct 62. Mounted to the wall of housing 11 externally and adjacent foraminous member 50 is vibratory electric motor 70, powered from a source not shown, which preferably has its axis of rotation transverse to the parts exit path defined by parts exit chute 52. The vibratory motor 70 is thus associated with foraminous member 50 for assisting travel of finished parts along said foraminous member 50 and out of said parts exit 52. Other vibratory, including oscillatory and reciprocatory, means can be employed, so long as said means is operatively associated with the foraminous member for accomplishing this same result. For example, an ordinary electric motor may be employed to impart vibrations to foraminous member 50, which may be hinged at one end to housing 11, by means of a simple cam or offset disc and arm arrangement, whereby vibrations are imparted to the foraminous member 50 in the manner of a usual "shaker screen." Alternatively, other arrangements for imparting vibrations to the foraminous member, when the housing 11 is rotated to parts-separation or exit position, may be employed.

Upon completion of a finishing cycle, the device of the invention is changed from finishing to parts-separation or ejection position, as shown in FIG. 3, by simply rotating housing 11 on its horizontal axis by means of shaft 14, cylinder 26, and arm or crank 28. As shown in FIG. 3, in parts-separation or ejection position, foraminous member 50 is slightly inclined toward the exit opening of the machine and exit opening chute 52. Storage compartment 55 now constitutes the downward portion of the housing, with bottom 56 defining the bottom of said storage compartment 55. Vibratory motor 70 is shown secured to the outside of housing 11 and adjacent foraminous member 50 for assisting separation of finished parts from finishing media and exit of parts along foraminous member and out of exit chute 52. As shown, the axis of rotation of vibratory motor 70 is transverse to the path of travel of parts along foraminous member 50 and out exit chute 52.

In FIG. 4 is shown a multi-stage unit, in all respects like the single-stage unit of FIG. 1 except that it is designed for successive finishing of parts in successive compartments and stages thereof, ordinarily with different grades of finishing material in each compartment. FIG. 5 shows a view along line 5—5 of FIG. 3 when FIG. 3 is a two-stage unit. The right-hand side of FIG. 5 shows the view when FIG. 3 is a single-stage unit with only a single return duct 62 being shown, in which case shadowed crown or V-baffle 58 is present instead of slant baffle 58A. As seen in FIG. 5, when a multi-stage unit is rotated to a parts-separation or ejection position, media within the first compartment falls through the apertures in foraminous member 50A and collects in the bottom of the first compartment below slant baffle 58A for return to the finishing chamber of the first compartment via internal duct opening 60 and duct 62 upon return of housing 11 to finishing position. Meanwhile, finished parts or workpieces are collected upon foraminous member 50A and are moved sideways under the influence of vibrations from vibratory motor 70 into the bottom of the second compartment and below slant baffle 58A for return to the finishing chamber of the second compartment, upon rotation of the housing 11 back to finishing position, through internal duct opening 60 and duct 62. After completion of a further finishing operation, subsequent rotation of the housing to parts-separation position results in a repetition of the procedure just described, with the finished parts then in the second compartment impinging upon screen 50 and marching across screen 50 and out exit chute 52 under the influence of vibrations from the associated vibratory motor 70, whereas the freshly-finished parts in the first compartment once again pass along foraminous member 50A, out of the first compartment, and into the second compartment for transfer to the finishing chamber 33 of the second compartment upon rotation of housing 11 back to finishing position.

In operation, parts or workpieces to be finished and loose aggregate finishing media are introduced in suitable proportions and, if desired, along with suitable finishing compound, either liquid or solid or both, into opening 13 of housing 11. Actuation of motor 46 causes rotation of shaft 38 in bearings 45, with concurrent rotation of spinner bowl 34, which causes integral admixture and relative movement between the parts or workpieces to be finished and the finishing media, both on a micromolecular and a macromolecular scale. After completion of the finishing cycle, cylinder 26 is activated by means not shown to cause extension of arms 28 and rotation of shaft 14 within bearing blocks 16 and consequent rotation of housing 11 to the parts-separation or ejectment (and media transfer) position shown in FIG. 3. With the housing in this position, vibratory motor 70 is actuated, causing vibrations to be transmitted to foraminous member 50, with the consequence that the parts, which exit from finishing chamber 33 via directional plate 48 and collect upon foraminous member 50, are caused to march across said foraminous member 50 in the direction of exit chute 52, whereas finishing media falls through the apertures of the foraminous member and is collected in storage chamber 55. After allowing a suitable period of exit of finished parts from the machine via exit chute 52, the cylinder 26 is actuated in reverse, thereby again returning housing 11 to the finishing position shown in FIG. 1 or, if a multi-stage machine, as shown in FIG. 4. Upon this rotation back to the finishing position, finishing media collected in storage chamber 55 is directed by baffle 58 via duct opening 60 and duct 62, with door or damper 66 turned toward internal duct opening 64, back into finishing chamber 33. Alternatively, if it is desired to change the finishing media in the machine for any reason, damper 66 may be manipulated by external handle 68 so as to direct the finishing media out of the machine via duct exterior opening 63. The motor 46 for rotation of spinner bowl 34 is generally activated only during a finishing cycle, whereas the vibratory motor 70 associated with foraminous member 50 is generally activated only during a parts-separation of ejection cycle and, optionally, during a media return cycle. Each of the two motors thus performs the function for which it is particularly designed, namely, motor 46 has as its function to cause rotation of spinner bowl 34 for finishing parts in finishing chamber 33 and accomplishes this result rapidly, efficiently, and effectively. Contrastingly, vibratory motor 70 has as its function to impart vibrations to foraminous member 50 for clean separation of finished parts from finishing media and for exit of finished parts from the machine via exit chute 52, is located adjacent foraminous member 50 and associated therewith, and therefore is likewise adapted for accomplishing its objective rapidly and efficiently, as well as assisting with return of media via duct 62 to the finishing chamber 33, or out of the machine via duct exterior opening 63, if desired. Accordingly, both the finishing cycle and the parts-separation cycle, as well as the media return cycle, are carried out with a maximum of rapidity, efficiency, and economy and, noteworthily, with an absolute minimum of manual labor. The apparatus of the present invention is even designed so as to adapt itself readily to automatic programming, with automatic filling of the machine with additional unfinished parts or work pieces and, if desired, additional finishing media through housing opening 13, a predetermined finishing cycle, a predetermined parts-separation cycle, return of finishing media to the finishing chamber or exit from the machine as desired, and so on ad infinitum without intervention of manual labor.

When a multi-stage apparatus is involved, such as the two-stage unit of FIG. 4 and FIG. 5, it may be advantageous to employ different grades of finishing media in each of the several compartments involved. For example, a coarse finishing media may be employed in the first finishing compartment and a finer finishing material in the second finishing compartment, thereby to upgrade the finish on the parts or workpieces as they proceed through the several stages involved. The procedure employed is exactly the same as previously described for a single-stage unit. However, upon rotation of the housing to parts-separation or ejection position, the finishing media in the first compartment proceeds from foraminous member 50A to the bottom of the first compartment of the housing, whereas the finished parts traverse foraminous member 50A and are deposited in the bottom of the second compartment of the housing. Upon rotation of the housing back to finishing position, the finishing media in the first compartment returns to the finishing chamber of the first compartment, whereas the finishing media in the second compartment returns to the finishing chamber of the second compartment along with the partially-finished parts deposited in the second compartment from the first compartment during the first parts-separation stage. Additional parts may then be introduced into the first compartment through housing opening 13 and a further finishing cycle undertaken. At the end of the second finishing cycle, rotation to the parts-separation position is repeated, whereupon the procedure involved is precisely as stated in the foregoing, with the exception that the now fully finished parts in the second compartment, upon rotation of the device to parts-separation position, are deposited upon foraminous member 50 and proceed to exit from the machine via exit chute 52, just as in a single-stage device. It goes without staying that the number of stages and compartments which can be arranged side-by-side in this manner is variable considerably, with the only variation from the two-stage unit being that all the compartments except the last compartment will have the foraminous member 50A so located for transfer of the partially-finished parts in one compartment into the storage chamber of the succeeding compartment, whereas the last compartment in the series will have its foraminous member 50 so arranged as to receive the fully finished parts and conduct them vibrationally under the influence of vibratory motor 70 toward exit chute 52 and thence out of the machine.

In brief then, after charging the finishing chamber with finishing media and unfinished parts and energizing the motor 46 for rotation of spinner bowl 34 for moving the mass of finishing media and unfinished parts within finishing chamber 33, a suitable period is allowed for attainment of the desired finish on the surface of the parts. The housing 11 is then rotated by an angle of slightly more than ninety degrees (90°), whereupon the mass of finishing media and finished parts flows out of the finishing chamber 33 and along plate 48 toward foraminous member 50. The finishing media passes through the foraminous member and is deposited in the storage chamber 55, whereas the finished parts move along the foraminous member 50 and out of the housing. After the parts are discharged from the machine and the finishing media transferred completely into the storage chamber, rotation of the housing back to the finishing position permits recharging with another batch of unfinished parts. In the parts-separation position, the separation of finishing media from finished parts and the exit of finished parts from the machine is assisted by vibrational impulses imparted to foraminous member 50 by means of vibratory motor 70 especially adapted for such purpose. If desired, upon rotation of the housing back to finishing position, the media may be transferred (if desired also with the aid of vibratory motor 70) back into the finishing chamber or out of the machine for replacement with a new or different type of finishing media which may be deposited in the finishing chamber 33 through housing opening 13 for finishing the surface of another batch of parts. Most frequently, the finishing media is transferred back into the finishing chamber for finishing the surface of another batch of similar parts. If it is desired that the finishing media and unfinished parts be mixed with fluid, e.g., water or liquid compound, in the finishing chamber, conventional fluid pumping systems are available which may be operatively associated with the housing for pumping and draining fluid into and out of the finishing chamber. A drain 43 is provided at the bottom of the housing 11 below finishing chamber 33 for elimination of any such fluid which may, during the finishing operation, seep through seal 37 and into the bottom of bearing housing 42.

A single duct 62 or more than one duct may be employed with the devices according to the present invention. As shown, two (2) ducts are employed even in a single-stage unit. It is to be understood however, that, in multi-stage arrangements, one duct is preferably employed with each stage or compartment of the finishing machine for redeposit of finishing media into the finishing compartment of the same compartment or, alternatively, for discharge of finishing media from the machine. The end of the foraminous member disposed in the first stage of a multi-stage finishing machine communicates with the second stage of the series, the second stage communicates with the third stage, and so on. A discharge chute communicates with the foraminous member in the last stage of the series for discharging parts from the machine. In any embodiment, it is immaterial whether a duct be located outside the wall of the machine housing, as shown, or inside said housing wall, as will be apparent to one skilled in the art.

As general considerations, it will be seen from the foregoing that the axis upon which the spinner member of the invention is mounted is generally vertical. In practice, this axis is usually substantially vertical or substantially normal to the bottom of the finishing chamber in which such spinner member is located. When the bottom of the finishing chamber is not inclined, then the axis is usually both substantially vertical and substantially normal to the bottom of the finishing chamber in which it is located. On the other hand, when the finishing chamber bottom is inclined, it is generally preferred that the axis be substantially normal to the bottom of the finishing chamber section in which the spinner member is located.

Also, as a general consideration, although it is preferred that the upstanding walls of the finishing chamber define a tub member which is either coaxially or concentrically arranged with respect to its complementary spinner member, it is only necessary that the walls of the finishing chamber define a tub member which is complementarily arranged with respect to its spinner member, so that the combination of spinner member and tub member comprises lower and upper portions of the finishing chamber. To this end, the walls of the tub member need not necessarily be coaxial or even concentric with its respective spinner member and, for certain applications, embodiments wherein the walls of the finishing chamber surrounding its particular spinner member may even advantageously be oval rather than completely annular and in certain cases may be advantageously oval or annular but off-center and not concentric with its complementary spinner member. However, for practical and performance reasons, as indicated in the foregoing, the upper tub member is preferably not only annular but also either coaxial or concentric with its respective lower spinner member.

From the foregoing, it will be seen that a novel semi-automatic or batch type centrifugal finishing apparatus which is self-separating and which embodies an automatic media return, whereby the finishing operation may be rapidly and efficiently carried out by means of a vertical centrifugal finishing apparatus, whereby the finishing media may be rapidly separated from finishing parts and finished parts discharged from the machine by vibratory means associated with the foraminous member employed for separating finished parts from finishing media, and whereby separated finishing media may then be rapidly transferred from the storage chamber of the apparatus to the finishing chamber thereof or, alternatively, out of the machine, if desired also under the influence of said vibrating means, and whereby all of the additional objects of the invention may be accomplished, has been provided by the present invention.

Although the finishing chamber of the apparatus of the present invention and its component parts, i.e., the lower spinner bowl and the upper tub portion thereof, are always generally "annular," as is any surrounding or defining wall thereof, it is not essential that such wall or chamber or part thereof be annular in any precise circular sense of the term. It is only necessary that the finishing chamber, any such part thereof, or any such defining or surrounding wall be generally annular, that is, insufficiently cornered so as to prevent the free flow of finishing media and parts to be finished therein and around the interior of the finishing chamber. For example (except at the juncture of the lower spinner bowl and the upper tub portion, where the annular periphery of the rotatable spinner bowl lies in opposed facing relationship to the annular lower edge of the non-rotatable tub portion, and where both must obviously be annular to permit the necessary spinner bowl rotation), such generally-annular finishing chamber, especially upper tub portion thereof and any surrounding or outer or defining wall therof, may be a decagonal, octagonal, hexagonal, or pentagonal cross-section, or any other somewhat cornered cross-section which does not detract from its generally-annular nature or interfere with the flow of parts and media about the interior of the finishing chamber therein, or with rotation of the spinner bowl about an essentially central and vertical axis. Although for purposes of ultimate convenience and operating efficiency a truly circular annular finishing chamber is preferred, other generally-annular finishing chambers may be employed with equal or only somewhat reduced efficiency, as will be apparent to one skilled in the art.

It is to be understood that the term "finishing media" is used generally herein to designate materials used to impart all types of finishes, including those finishes acquired with abrading material as well as with polishing material, and that polishing, abrading, deburring, edge-breaking, buffing, burnishing, and the like, are as usual only species of finishing. The term "finishing media," as used herein, is also intended to include all such materials which serve as loose, particulate, and solid finishing materials of the type presently employed in the trade and others of a similar nature whether natural or synthetic, including stone, porcelain, abrasive-filled clays, plastics, ceramics, wood, leather, or the like, and in any suitable shape or form as may be employed for the surface refinement and/or deburring of parts or workpieces, which are usually of metal or plastic.

It is to be understood that the invention is not to be limited to the exact details of construction, operation, or exact materials or embodiments shown and described, as obvious modifications and equivalents will be apparent to one skilled in the art, and the invention is therefore to be limited only by the full scope of the appended claims.

I claim:

1. A finishing machine for finishing the surface of unfinished parts with finishing media comprising a housing which is rotatable about a substantially horizontal axis, a finishing chamber in said housing for receiving unfinished parts and finishing media and for finishing of parts when said housing is in finishing position, a storage chamber in said housing adapted to receive finishing media from said finishing chamber when said housing is rotated to a parts-separation or ejection position, a foraminous member disposed in said housing for separating finishing media from parts, means for rotating said housing about a substantially horizontal axis from a finishing position to a parts-separation position and return, and means for transfer of finishing media from said storage chamber to said finishing chamber upon return of said housing from said parts-separation position to said finishing position, characterized in that said finishing chamber comprises an annular spinner member constituting a lower portion of said finishing chamber and a tub member upwardly arranged with respect to said spinner member and comprising an upper portion of said finishing chamber, said spinner member being adapted to rotate about a generally vertical axis when said housing is in finishing position, a rotational motion-producing assembly operatively associated with said finishing chamber and comprising rotatable support means for said spinner member adapted to rotate about substantially the same axis as its complementary spinner member when said housing is in finishing position and associated drive means for rotation of said rotatable support means, whereby said spinner member may be rotated with respect to said tub member for carrying out a finishing operation in said finishing chamber, and vibratory means operatively associated with said foraminous member for vibration of said foraminous member when said housing is in parts-separation position for separation of finishing media from parts, and a parts exit associated with said foraminous member for exit of finished parts from said machine when said housing is in parts-separation or ejection position and under the influence of said vibratory means.

2. The machine of claim 1, wherein said housing is resiliently mounted.

3. The machine of claim 2, wherein said vibratory means comprises a vibratory motor associated with said foraminous member.

4. The machine of claim 2, wherein said vibratory motor is so located that its axis of rotation is transverse to the path of travel of said parts as they travel along said foraminous member and out said parts exit.

5. The machine of claim 2, wherein said parts exit comprises a chute located adjacent said foraminous member.

6. The machine of claim 2, wherein said foraminous member is located in said housing between said finishing chamber and said storage chamber.

7. The machine of claim 2, wherein said foraminous member comprises a screen or grate.

8. The machine of claim 2, wherein said transfer means is operative to transfer finishing media from said storage chamber to said finishing chamber, or alternatively out of said machine, upon return of said housing from parts-separation position to finishing position.

9. The machine of claim 8, wherein said transfer means comprises duct means including associated internal and external openings and door or damper means for alternatively directing said finishing media either to said finishing chamber or out of said machine.

10. The machine of claim 2, wherein said housing constitutes a single-stage finishing unit.

11. The machine of claim 2, wherein said housing is divided into more than one compartment and wherein said machine constitutes a multi-stage finishing machine.

12. The machine of claim 11, wherein each compartment of said housing contains a separate foraminous member and wherein said foraminous members are so arranged for transfer of parts from one compartment to a next succeeding compartment upon rotation of said housing from parts separating position to finishing position and finally to a parts exit for exit of finished parts from said machine.

13. The machine of claim 2, wherein said finishing chamber comprises an annular sealing member for sealing but rotatable engagement of said spinner member with said tub member.

14. The machine of claim 2, wherein said rotatable support means for said spinner member comprise a shaft journaled in bearings mounted adjacent said spinner member and below said spinner member when said housing is in finishing position and wherein said drive means comprises a motor for driving said shaft.

15. The machine of claim 8, wherein said transfer means comprises duct means for directing said finishing media to said finishing chamber or out of said machine and wherein said vibratory means is also operatively associated with said duct means for assisting with travel of said finishing media along said duct means.

16. The machine of claim 12, wherein each compartment is fitted with a suitable baffle for return of the finishing media in that compartment back to the finishing chamber of that compartment upon rotation of said housing from parts-separating position to finishing position.

17. The machine of claim 2, wherein said vibratory means is also operatively associated with said transfer means for imparting vibrations thereto for assisting with return of finishing media from said storage chamber to said finishing chamber.

18. The machine of claim 17, wherein said transfer means comprises duct means and wherein said vibratory means is a vibratory motor operatively associated with said duct means.

19. The machine of claim 2, wherein said spinner member is bowl shaped.

20. The machine of claim 14, wherein said spinner member is bowl shaped.

* * * * *

UNITED STATES PATENT AND TRADEMARK OFFICE

CERTIFICATE OF CORRECTION

PATENT NO. : 4,363,194

DATED : December 14, 1982

INVENTOR(S) : Gunther W. Balz

It is certified that error appears in the above-identified patent and that said Letters Patent is hereby corrected as shown below:

Col 3, line 50: "member" should read "members".

Col 7, line 14: "of" should read "or".

Col 9, line 6: "compartment of the same compartment". should read "chamber of the same compartment.

Signed and Sealed this

*Fifth* Day of *April 1983*

[SEAL]

*Attest:*

GERALD J. MOSSINGHOFF

*Attesting Officer*

*Commissioner of Patents and Trademarks*